US007210974B1

(12) United States Patent
Meyer

(10) Patent No.: US 7,210,974 B1
(45) Date of Patent: May 1, 2007

(54) SLIP-ON LINKAGE

(75) Inventor: Jeffry R. Meyer, Greensburg, PA (US)

(73) Assignee: Pennsylvania Breaker LLC, Canonsburg, PA (US)

( * ) Notice: Subject to any disclaimer, the term of this patent is extended or adjusted under 35 U.S.C. 154(b) by 0 days.

(21) Appl. No.: 11/368,043

(22) Filed: Mar. 3, 2006

(51) Int. Cl.
*B63H 23/34* (2006.01)

(52) U.S. Cl. ..... 440/83; 403/312

(58) Field of Classification Search ..... None
See application file for complete search history.

(56) References Cited

U.S. PATENT DOCUMENTS

| | | | | | |
|---|---|---|---|---|---|
| 73,100 | A | * | 1/1868 | Hubbard | 403/309 |
| 145,100 | A | * | 12/1873 | Gibbins | 403/309 |
| 3,851,983 | A | * | 12/1974 | MacKenzie | 403/312 |
| 4,510,359 | A | | 4/1985 | de Calvino y Teijeiro | |
| 5,026,199 | A | * | 6/1991 | Schmid et al. | 403/313 |
| 5,154,652 | A | * | 10/1992 | Ecklesdafer | 440/83 |
| 5,508,487 | A | | 4/1996 | Smith et al. | |
| 5,569,891 | A | | 10/1996 | Freeman et al. | |
| 5,902,978 | A | | 5/1999 | Zehnder et al. | |
| 6,072,136 | A | | 6/2000 | Wehrli, III et al. | |

* cited by examiner

*Primary Examiner*—Lars A. Olson
(74) *Attorney, Agent, or Firm*—Pepper Hamilton LLP

(57) ABSTRACT

A linkage for coupling to at least one rotatable shaft of a high voltage circuit breaker has an elongated body having a central body portion and opposed end portions. At least one of the end portions comprises a pair of parallel side walls and a bottom wall extending longitudinally from the central body portion along the end portion. Each of the parallel side walls comprises an outer side wall portion and an inner side wall portion. Each outer side wall portion extends longitudinally beyond an outer end of a lower part of the inner side wall portion and an outer end of the bottom wall. The parallel side walls and bottom wall form a slot having an open end adapted to receive a square or rectangular end of a rotatable shaft in the slot. The slot has an upper longitudinal opening between the adjacent upper edges of the side walls and a lower longitudinal opening between adjacent lower edges of the outer side wall portions that extend beyond the bottom wall. A plurality of connectors is provided for clamping the parallel side walls against the end of the rotatable shaft to secure the rotatable shaft in the slot.

25 Claims, 8 Drawing Sheets

PRIOR ART

PRIOR ART

PRIOR ART

SLIP-ON LINKAGE

BACKGROUND

1. Technical Field

The disclosure contained in this document relates to a linkage for rotating mechanisms, and particularly to a linkage for coupling the rotating shafts of a high voltage circuit breaker or recloser in end-to-end relationship.

2. Description of the Related Art

High voltage circuit breakers are used in the distribution of three phase electrical energy to prevent the flow of current in a circuit when a fault or other disturbance is detected. When a sensor or protective relay detects a fault or disturbance in the circuit, current-carrying contacts in each of the three phases are physically separated to prevent current flow until the circuit is clear. A recloser is similar to a circuit breaker, except that a circuit breaker opens a circuit and keeps it in the open position indefinitely, but a recloser may open and reclose the circuit several times in quick succession to allow a temporary fault to clear. A circuit breaker or recloser includes interrupters for physically separating the current-carrying contacts and an operating or switching mechanism for providing the energy necessary to accomplish separation of the contacts.

A linkage is provided for mechanically coupling the operating mechanism to each of the interrupters. In general, the linkages or mechanical couplings may be one of several types. For example, in a "push/pull" type coupling, conductive elements are moved into engagement when a rigid rod is moved in one direction, and the coupling elements are disengaged when the rod is moved in the opposite direction. In a rotational coupling, one of the conductive elements moves in response to the rotation of a bell crank as a link element between the three phases of the breaker rotates.

An example of such a mechanical coupling is illustrated in U.S. Pat. No. 5,569,891. FIG. 3 of this patent, which is reproduced herein as FIG. 1, shows a prior art example of a dependent pole mechanism for opening and closing all three phases of a circuit breaker simultaneously. In FIG. 1, a single connecting rod 22 connects operating mechanism 20 to two rotatable linking elements 25 and 26 by lever 24. The linking elements are coupled to bell cranks in the terminal portion of the interrupters (not shown). FIG. 4 of the patent, which is reproduced herein as FIG. 2, shows an example of a linkage for independent pole operation of the circuit breaker. In FIG. 2 herein, three independently operated connecting rods, 32, 33 and 34, are provided. Two of the connecting rods 32 and 33 are connected to lever assemblies 40 and 41 which couple the connecting rods to rotatable linking elements 37 and 39, respectively. Lever assemblies 40 and 41 also provide a mechanical bearing for decoupling connecting rods 32 and 33 from rotatable linking elements 38 and 36, respectively. The third connecting rod 34 is connected to a lever assembly that does not have a bearing for decoupling from a linking element. FIG. 6 of the patent, which is reproduced herein as FIG. 3, shows a lever assembly 40 having aperture 62 for mechanically coupling to one linking element and a hollow opening 63 with bearings 67 for decoupling from a second linking element. The lever assemblies are coupled to the one linking element by splining, pinning or bolting.

Rotating linkages that need to carry high energy loads without severe flexing or looseness have typically been made using multiple components with special splines and heavy bolted joints used to carry the loads. Typically these linkages allow for little axial alignment variation, have high stresses, and can become loose after many high load operations. These characteristics result in a high cost, dimensionally unforgiving, and failure prone design that requires careful manufacturing and detailed assembly procedures. There is a need for a linkage that overcomes the shortcomings of prior linkage designs.

SUMMARY

In one embodiment, a linkage is provided for coupling to at least one rotatable shaft having a square or rectangular end. The linkage comprises an elongated body having a central body portion and opposed end portions. At least one of the end portions comprises a pair of parallel side walls and a bottom wall extending longitudinally from the central body portion along the end portion. The parallel side walls and bottom wall form a slot having an upper longitudinal opening between an upper edge of the side walls and an open end between an outer end of the side walls and bottom wall. The slot is adapted to receive a square or rectangular end of a rotatable shaft. A plurality of connectors is provided for clamping the parallel side walls against the end of the rotatable shaft to secure the rotatable shaft in the slot. The connectors extend transversely across the upper longitudinal opening of the slot at spaced locations along the length and adjacent an upper surface of the side walls. In some embodiments, each of the connectors may extend through mateably aligned holes in the upper portion of the side walls and a body portion of each connector may abut an upper surface of the end of the rotatable shaft. In other embodiments the linkage may be cylindrical. And in still further embodiments the central portion of the linkage may be hollow.

In another embodiment, the linkage comprises an elongated body having a central body portion and opposed end portions. At least one of the end portions of the linkage comprises a pair of parallel side walls and a bottom wall extending longitudinally from the central body portion along the end portion. In this embodiment, each of the parallel side walls comprises an outer side wall portion and an inner side wall portion. Each outer side wall portion extends longitudinally beyond an outer end of each inner said side wall portion and an outer end of the bottom wall. The parallel side walls and bottom wall form a slot having an open end adapted to receive a square or rectangular end of a rotatable shaft in the slot. The slot has an upper longitudinal opening between the upper edges of the side walls and a lower longitudinal opening between adjacent lower edges of the outer side wall portions that extend beyond the bottom wall. A plurality of connectors is provided for clamping the parallel side walls against the end of the rotatable shaft to secure the rotatable shaft in the slot. In some embodiments, each of the connectors may extend through mateably aligned holes in the upper portion of the side walls and a body portion of each connector may abut an upper surface of the end of the rotatable shaft. In other embodiments the linkage may be cylindrical. And in still further embodiments the central body portion of the linkage may be hollow.

DESCRIPTION OF THE DRAWINGS

Before explaining at least one embodiment in detail, it is to be understood that the invention is not limited in its application to the details of construction and to the arrangements of the components set forth in the description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting. For example, all singular forms and the words "a," "an," and "the" include the plural reference unless expressly stated otherwise.

DETAILED DESCRIPTION

Figure 1:
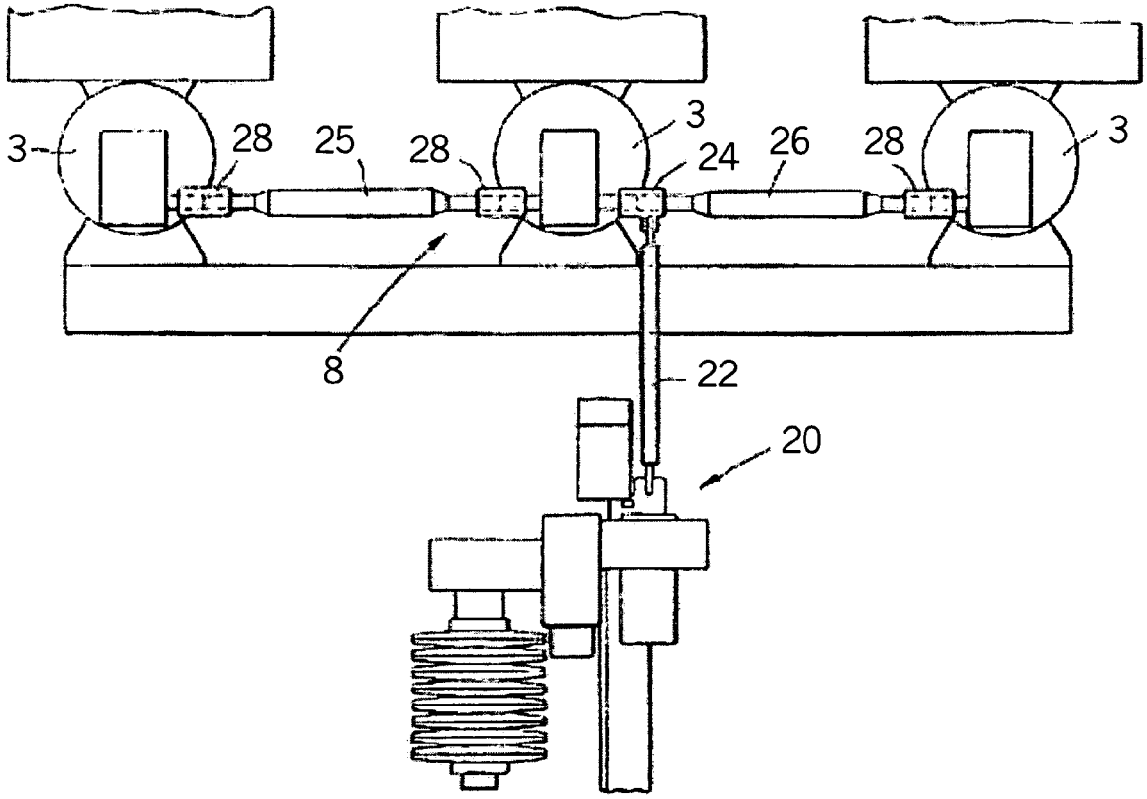
FIG. 1 illustrates an exemplary prior art rotating linkage with a single connecting rod for a three-phase circuit breaker.
Figure 2:
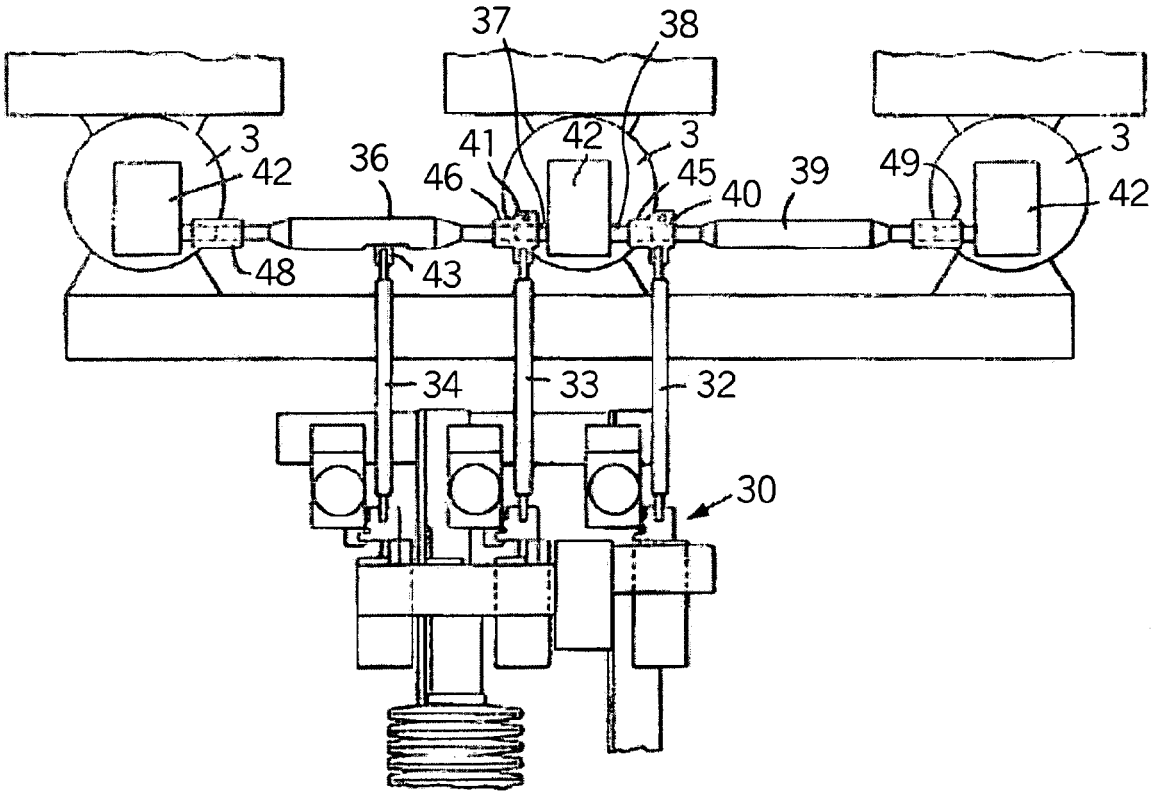
FIG. 2 illustrates an alternate embodiment of FIG. 1 in which three connecting rods are used.
Figure 3:
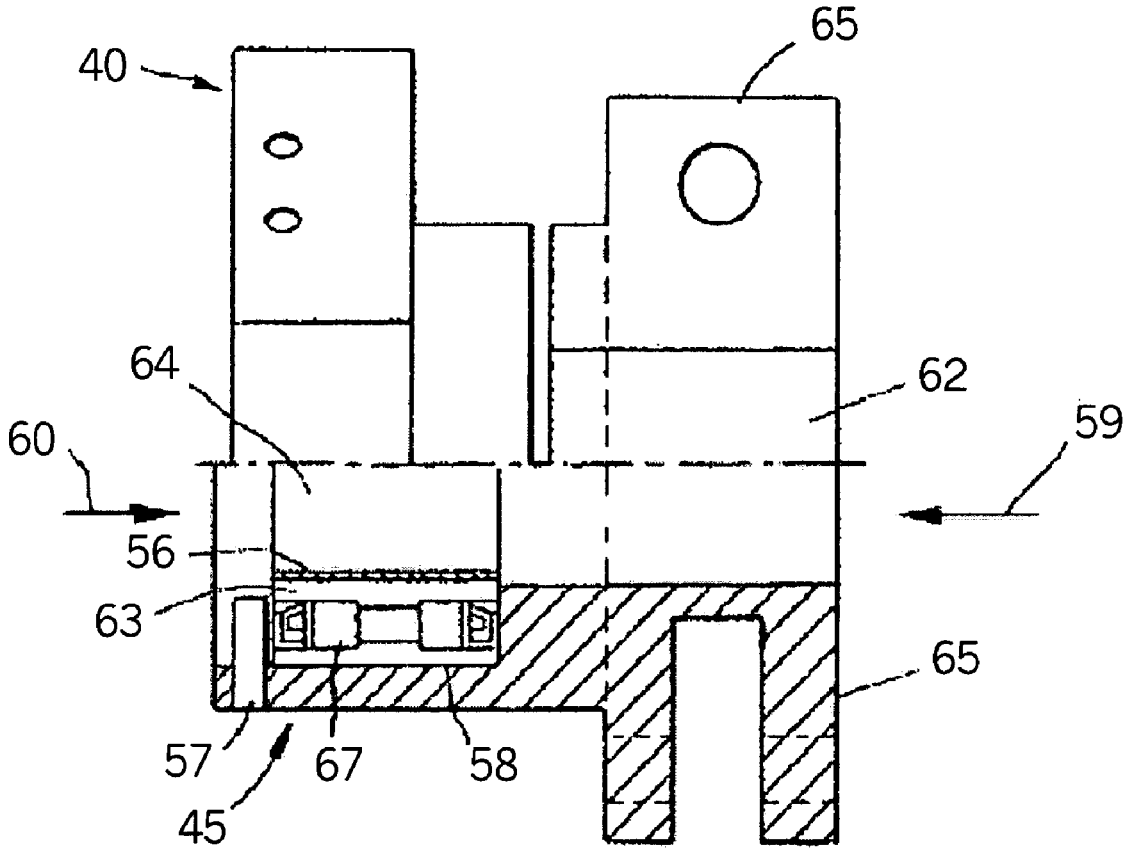
FIG. 3 illustrates a prior art lever assembly for connecting a connecting rod to a rotating link member.
Figure 4:
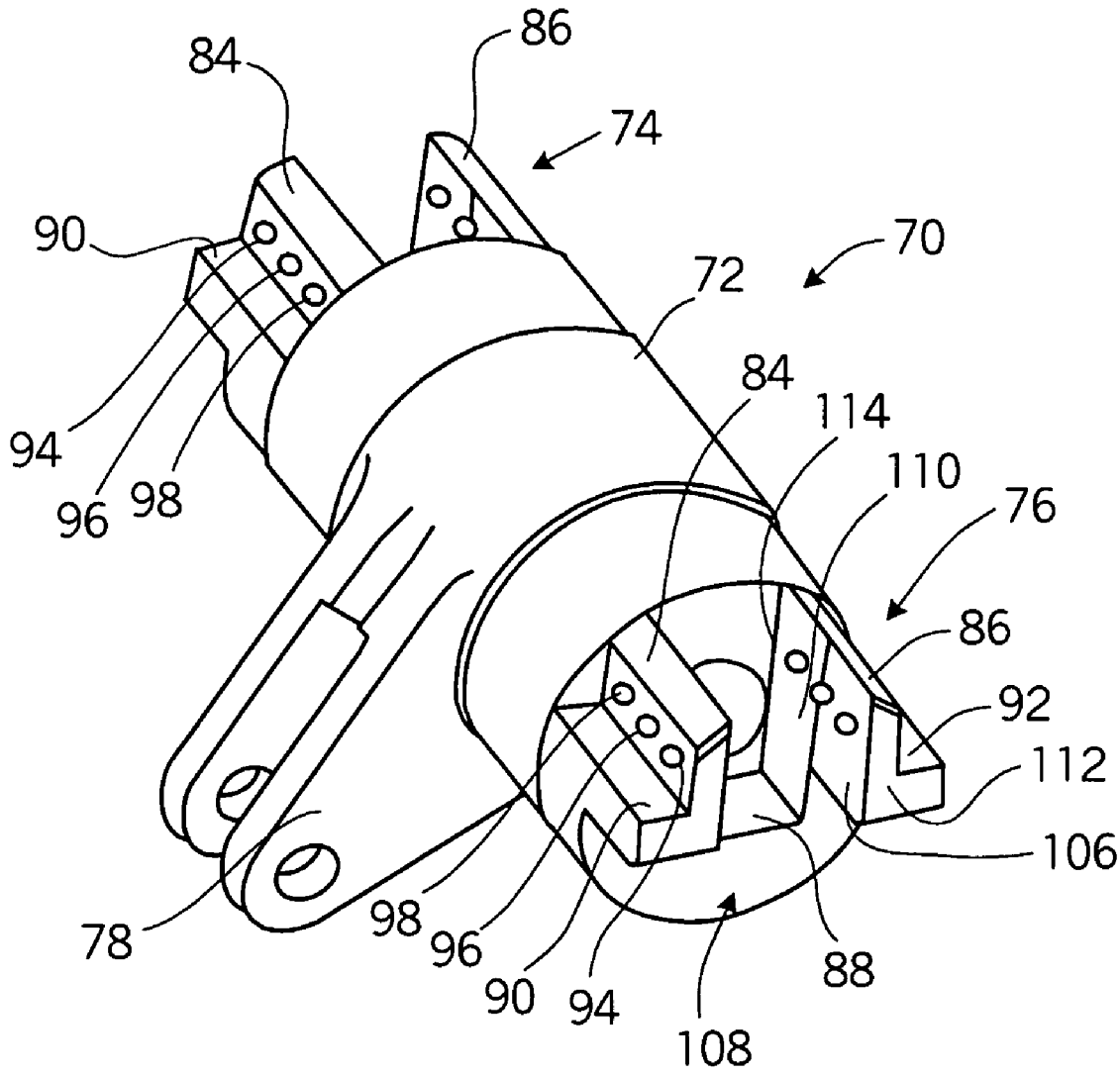
FIG. 4 is a perspective view of a coupling for connecting two rotatable shafts of a high voltage circuit breaker in end-to-end relationship.
Figure 5:
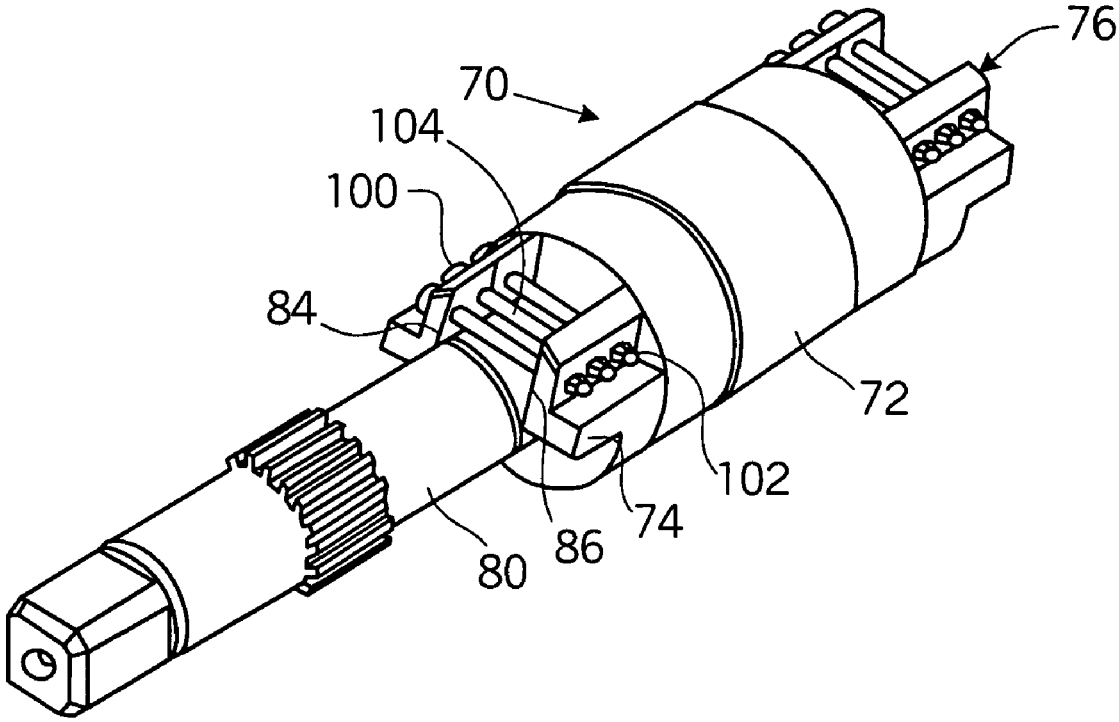
FIG. 5 is a perspective view of the coupling of FIG. 4 showing a rotatable shaft having a square end inserted in the coupling with bolts and nuts securing the end of the shaft in the coupling.

Referring to FIGS. 4 and 5, a linkage 70 for a high voltage circuit breaker comprises a central body portion 72 and opposed end portions 74 and 76. Typically, a lever 78 is provided on central body portion 72 for connection to a connecting rod or other mechanical power output from an operating mechanism of the circuit breaker. The lever may be integral with the central body portion or separately attached. The lever may be centrally located along the length of the linkage or offset toward one end. FIG. 5 shows a rotatable shaft 80 having a square end secured in end portion 74 of the linkage. Referring again to FIG. 4, each end portion of the linkage may have a pair of spaced side walls 84 and 86 and a bottom wall 88. Each of the side walls may have a flange 90 and 92 extending outwardly for additional strength. A plurality of pairs of mateable holes 94, 96 and 98 are provided in the side walls for receiving connectors such as bolts, screws or other fastening devices. FIG. 5 shows a plurality of high strength bolts 100 extending through the holes with each bolt having a nut 102 threaded on one end for securing the bolt. In some embodiments, a central body portion 104 of the bolts contacts an upper surface of the end of the shaft so as to act as a fourth wall of the joint to fully retain the shaft end in the linkage.

Figure 6:
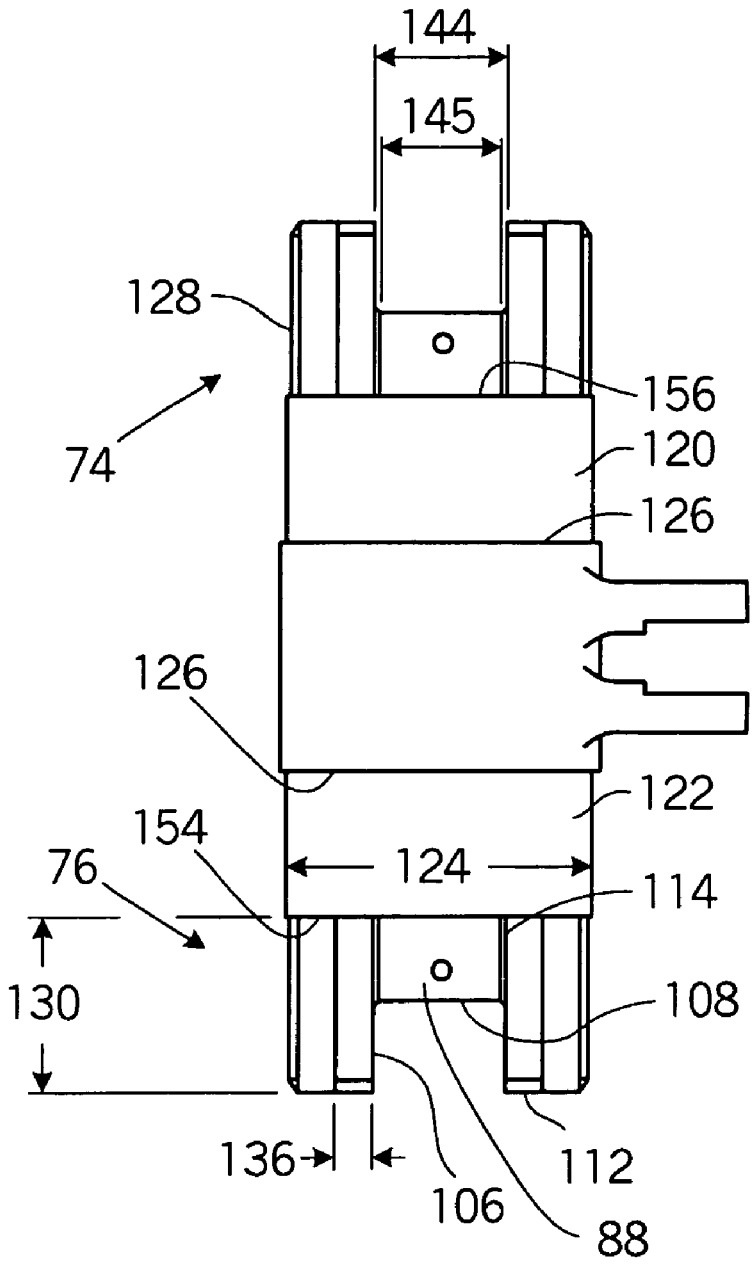
FIG. 6 is a top view of the coupling of FIG. 4.

Referring to FIG. 6, an outer portion 106 of each side wall extends longitudinally beyond an outer end 108 of bottom wall 88 so that the outer portions of the side walls can be clamped together in spring-like fashion against the end of the rotatable shaft more easily than the inner portions 110 of the sidewalls. In this regard, at least one pair of mateable holes as described above is provided in the outer portion 106 of the sidewalls so that a connector can be inserted through the holes and secured so as to draw the outer portion of the sidewalls together against the end of the rotatable shaft. This spring-like connection acts to dampen and limit any harmful impacting in the cavity when rotational forces are reversed during high speed operation. It also keeps the joint tight and helps to prevent the bolts from loosening through many flexing cycles.

In some embodiments, the distance or lateral spacing between the outer portions 106 of the sidewalls is greater than the distance or lateral spacing between inner portions 110 of the sidewalls. For example, the distance between the outer portions 106 may be a first distance and the distance between the inner portions 110 may be a second distance so that the distance or spacing between the outer and inner portions decreases in step-like fashion. In other embodiments the distance between the sidewalls may be tapered from a distance greater at the outer end 112 of the sidewalls to a smaller distance between the inner end 114. The step-like spacing may be easier and cheaper to manufacture than the tapered pacing. In both cases, the difference in spacing between the outer and inner ends of the sidewalls provides leeway for significant axial misalignment of the linkage and rotatable shaft which can change during shaft rotation. Also the stepped or tapered cavity forces the major loading to be in the inner portion of the linkage where it is the strongest and most rigid.

Figure 7:
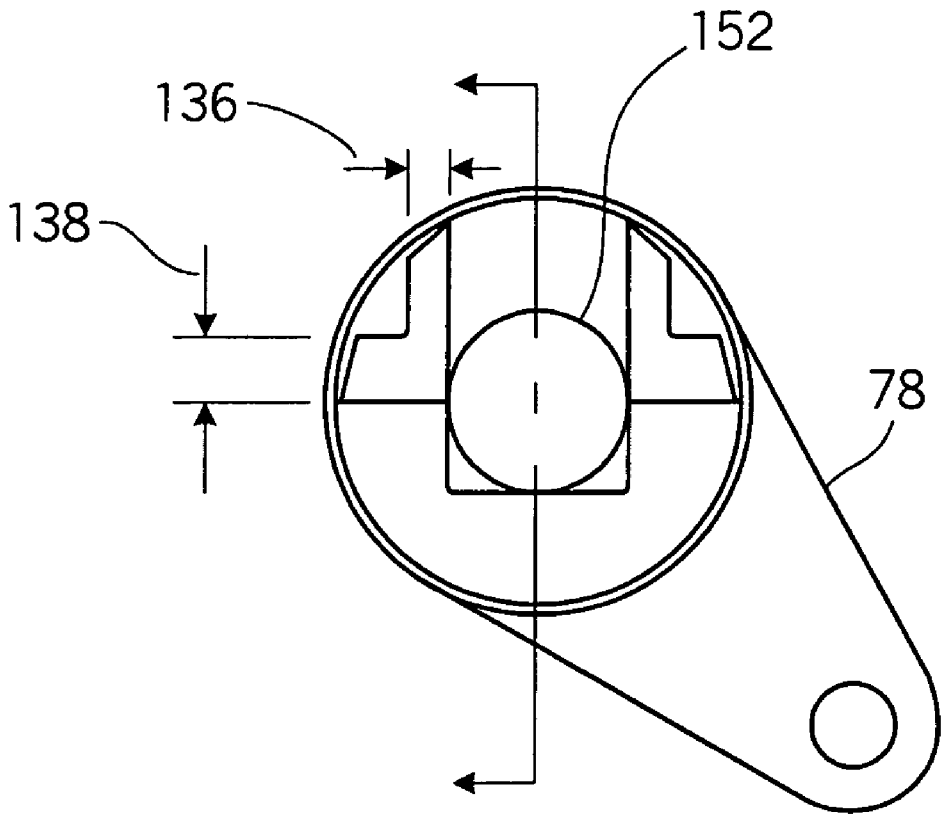
FIG. 7 is an end view of the coupling in FIG. 4.
Figure 8:
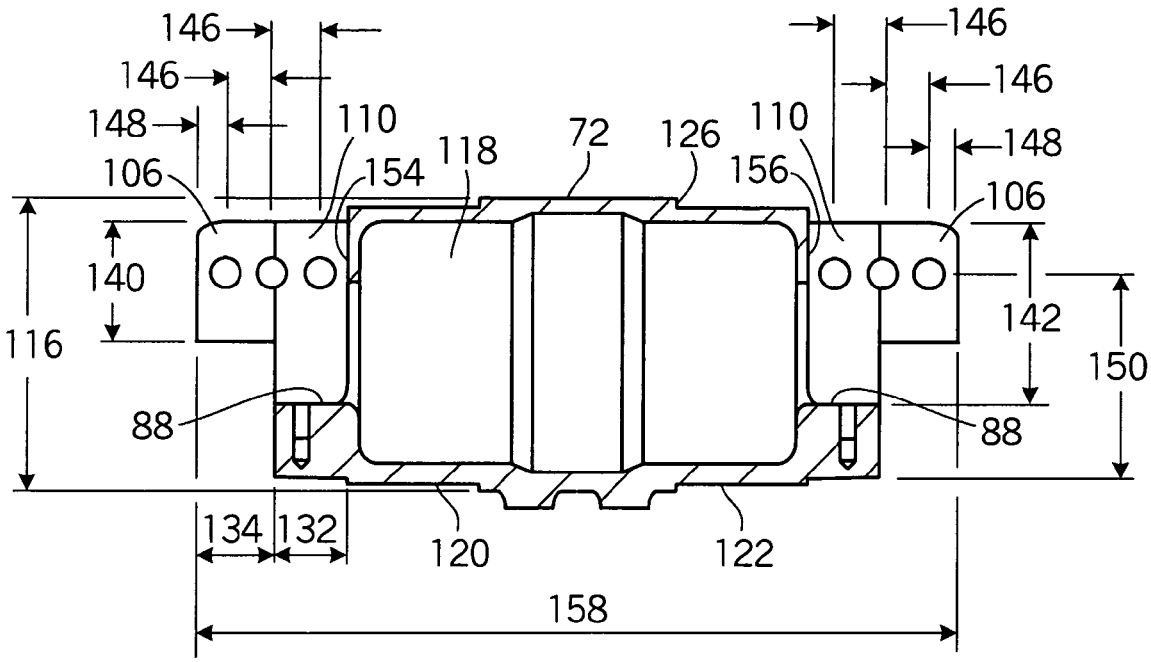
FIG. 8 is a half cross sectional view taken at VIII–VVII of FIG. 7.

Referring to FIGS. 6, 7 and 8, a possible example of a linkage for a high voltage circuit breaker may be provided as follows: A cylindrical body of precipitation hardenable stainless steel, such as 17-4PH steel, is cast, heat treated and then machined. In FIG. 8, the central body portion 72 has an outer diameter 116 of about 5.75 inches and a hollow interior 118 so that the overall weight of the linkage may be reduced. In FIG. 6, outer portions 120 and 122 of the central body portion are machined to a diameter 124 of about 5.494 to about 5.497 inches in order to provide a smooth surface and a stop edge 126 for locating a reaction force control arm which is disclosed in a separate patent application of assignee filed on the same date as the present application. Referring to FIGS. 6 and 8, end portions 74 and 76 are machined to a diameter 128 of about 5.37 inches and have a length 130 of about 3 inches. Additional metal is removed by machining to form a slot between sidewalls 84 and 86 and bottom wall 88. Referring to FIG. 8, the bottom wall 88 and the inner portions 110 of the sidewalls have a length 132 of about 1.40 inches. The outer portions 106 of the sidewalls have a length 134 of about 1.60 inches. The sidewalls have a thickness 136 of from about 0.592 to about 0.590 inches. The flanges 90 and 92 have a thickness 138 of about 0.5 inches. The outer portions of the sidewalls have a height 140 of about 2–4 inches. The tab created by 140 serves as a flexible member that bends around the end of 80 to form a tight but flexible end connection to adjust for size tolerances and to allow soft reversal loading of the shaft 80 in the linkage pocket. The depth 142 of the slot from the upper edge of the inner portion of the sidewalls to the upper or inner surface of the bottom wall is about 3.7 inches. The width 144 of the slot between outer portions 106 of the sidewalls is about 2.396 to about 2.4 inches and the width 145 of the slot between the inner portions 114 of the sidewalls is about 2.383 to about 2.386 inches in order to form a step-like shape in the slot. Three pairs of mateable holes 94, 96 and 98 (FIG. 8) are drilled in each sidewall with the center of each hole spaced a distance 146 of about 1 inch from the center of each adjacent hole. The center of holes 94 and 96 are spaced a distance 148 of about 0.5 inches from each end of the sidewall. Connecting hardware (such as bolts) assembled through these holes may form a fourth wall to completely encompass the ends of the rotatable shaft 80. Finally the center of each hole is spaced a distance 150 of about 1.420 to 1.425 inches from the lower edge of each sidewall. A hole 152 (FIG. 7) of about 2.3 inches diameter is drilled or otherwise formed in each end of central body portion 72. Opposed end surfaces 154 and 156 of central body portion 72 serve as a stop surfaces for properly locating the end of the rotatable shafts in the linkage. The overall length 158 of the linkage is about 15.75 inches. All sizes listed in this paragraph are merely exemplary. Other sizes and dimension ratios are possible depending on the desired application.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art, each of which are also intended to be encompassed by the following claims.

What is claimed is:

1. A linkage for coupling to at least one rotatable shaft having a square or rectangular end, said linkage comprising:

an elongated body having a central body portion and opposed end portions, wherein at least a first of the end portions comprises a pair of parallel side walls and a bottom wall extending longitudinally from the central body portion along the end portion;

the parallel side walls and bottom wall form a slot having an upper longitudinal opening between adjacent upper edges of the side walls and an open end between an outer end of the side walls and an outer end of the bottom wall, the slot being adapted to receive a square or rectangular end of a rotatable shaft; and a plurality of connectors for clamping the parallel side walls of said first end portion against the end of a first rotatable shaft to secure the first rotatable shaft in the slot.

2. The linkage of claim 1 wherein the connectors extend transversely across the upper longitudinal opening of the slot at spaced locations along the length and adjacent the upper edges of the side walls.

3. The linkage of claim 1 wherein each of the connectors extends through mateably aligned holes adjacent the upper edges of the side walls.

4. The linkage of claim 1 wherein a body portion of each connector abuts an upper surface of the end of the rotatable shaft, completing a retaining pocket.

5. The linkage of claim 1 wherein the outer peripheral surface of the central body portion of the linkage is cylindrical.

6. The linkage of claim 5 wherein the outer peripheral surface of the bottom wall of said end portion is about semi-cylindrical and an inner surface of the bottom wall is planar.

7. The linkage of claim 1 wherein the central body portion of the linkage is hollow and said central body portion has a stop surface adjacent to said end portion for properly locating the end of said first rotatable shaft in the end portion.

8. The linkage of claim 1 wherein the distance between said sidewalls at an outer end thereof is greater than the distance between said sidewalls at an inner end thereof.

9. The linkage of claim 8 wherein the distance between an outer side wall portion is a first distance and the distance between an inner side wall portions is a second distance, said first distance being greater than said second distance.

10. The linkage of claim 1 wherein said central body portion has a lever thereon.

11. The linkage of claim 1 wherein:

the second of said end portions comprises a pair of parallel side walls and a bottom wall extending longitudinally from the central body portion along the end portion;

the parallel side walls and bottom wall form a slot having an upper longitudinal opening between adjacent upper edges of the side walls and an open end between an outer end of the side walls and an outer end of the bottom wall, the slot being adapted to receive a square or rectangular end of a second rotatable shaft; and a plurality of connectors are positioned for clamping the parallel side walls of said second end portion against the end of a second rotatable shaft to secure the second rotatable shaft in the slot.

12. The linkage of claim 1, further comprising a flexible member that bends around an end of the shaft.

13. A linkage for coupling to at least one rotatable shaft having a square or rectangular end, said linkage comprising:

an elongated body having a central body portion and opposed end portions, wherein:

at least a first of the end portions comprises a pair of parallel side walls and a bottom wall extending longitudinally from the central body portion along the end portion, each of the parallel side walls comprises an outer side wall portion and an inner side wall portion, each outer side wall portion extends longitudinally beyond an outer end of a lower part of the inner side wall portion and an outer end of the bottom wall, the parallel side walls and bottom wall form a slot having an open end adapted to receive a square or rectangular end of a rotatable shaft in the slot, the slot has an upper longitudinal opening between the adjacent upper edges of the side walls and a lower longitudinal opening between adjacent lower edges of the outer side wall portions that extend beyond the bottom wall; and a plurality of connectors positioned to clamp the parallel side walls against the end of a first rotatable shaft to secure the first rotatable shaft in the slot.

14. The linkage of claim 13 wherein the connectors extend transversely across the upper longitudinal opening of the slot at spaced locations along the length and adjacent the upper edges of the side walls.

15. The linkage of claim 13, wherein each of the connectors extends through mateably aligned holes in the upper portion of the side walls.

16. The linkage of claim 13, wherein a body portion of each connector abuts an upper surface of the end of the rotatable shaft.

17. The linkage of claim 13, wherein at least one of said connectors is located adjacent an upper edge of the outer portion of said side walls.

18. The linkage of claim 13, wherein the outer peripheral surface of the central body portion of said linkage is cylindrical.

19. The linkage of claim 18, wherein the outer peripheral surface of the bottom wall of said end portion is about semi-cylindrical and an inner surface of the bottom wall is planar.

20. The linkage of claim 13, wherein the central body portion of the linkage is hollow and said central body portion has a stop surface adjacent to said end portion for properly locating the end of said first rotatable shaft in the end portion.

21. The linkage of claim 13 wherein the distance between said sidewalls at an outer end thereof is greater than the distance between said sidewalls at an inner end thereof.

22. The linkage of claim 21 wherein the distance between said outer side wall portions is a first distance and the distance between said inner side wall portions is a second distance, said first distance being greater than said second distance.

23. The linkage of claim 13 wherein said outer side wall portions each have a flange extending laterally outward from a lower edge of said outer side wall portions.

24. The linkage of claim 13 wherein a second of the end portions comprises a pair of parallel side walls and a bottom wall extending longitudinally from the central body portion along the end portion, each of the parallel side walls comprises an outer side wall portion and an inner side wall portion, each outer side wall portion extends longitudinally beyond an outer end of a lower part of the inner side wall portion and an outer end of the bottom wall;

the parallel side walls and bottom wall form a slot having an open end adapted to receive a square or rectangular end of a rotatable shaft in the slot, the slot has an upper longitudinal opening between the adjacent upper edges of the side walls and a lower longitudinal opening between adjacent lower edges of the outer side wall portions that extend beyond the bottom wall;

a plurality of connectors is provided for clamping the parallel side walls against the end of a second rotatable shaft to secure the second rotatable shaft in the slot.

25. The linkage of claim 13, wherein the linkage is coupled to at least one rotatable shaft of a high voltage circuit breaker.

* * * * *